US005661498A

United States Patent [19]

Goto et al.

[11] Patent Number: 5,661,498

[45] Date of Patent: Aug. 26, 1997

[54] POLARIZATION-UNIVERSAL RADIAL LINE SLOT ANTENNA

[75] Inventors: Naohisa Goto; Makoto Ando, both of Kawasaki; Yasuhiro Okazaki, Tokyo, all of Japan

[73] Assignee: Toppan Printing Co., Ltd., Tokyo, Japan

[21] Appl. No.: 284,467

[22] PCT Filed: Dec. 18, 1992

[86] PCT No.: PCT/JP92/01659

§ 371 Date: Nov. 18, 1994

§ 102(e) Date: Nov. 18, 1994

[51] Int. Cl.[6] ..... H01Q 13/10

[52] U.S. Cl. ..... 343/771; 343/770

[58] Field of Search ..... 343/771, 770; H01Q 21/24, 13/22

[56] References Cited

U.S. PATENT DOCUMENTS

| | | | |
|---|---|---|---|
| 4,819,003 | 4/1989 | Goto et al. | 343/771 |
| 5,049,895 | 9/1991 | Ito et al. | 343/771 X |

FOREIGN PATENT DOCUMENTS

| | | | |
|---|---|---|---|
| 57-87603 | 6/1982 | Japan . | |
| 59-32205 | 2/1984 | Japan . | |
| 0200602 | 10/1985 | Japan | 343/771 |
| 3-174807 | 7/1991 | Japan . | |
| 4-48806 | 2/1992 | Japan . | |

*Primary Examiner*—Donald T. Hajec
*Assistant Examiner*—Tho Phan
*Attorney, Agent, or Firm*—Armstrong, Westerman, Hattori, McLeland & Naughton

[57] ABSTRACT

A polarization-universal radial line slot antenna has a slot plate formed with numerous slots, a frame, and a partition plate interposed between the slot plate and the frame to form an upper layer waveguide and a lower layer waveguide. A pair of first and second feeding devices are provided in a central portion of the antenna. The first feeding device has a first matching member protruding into the upper layer waveguide for feeding thereto a radio wave diverging from a center to a periphery so that a left-hand circular polarized wave is emitted from the slots. The second feeding device has a second matching member for feeding a radio wave which passes through the lower layer waveguide and then converges from a periphery to a center of the upper layer waveguide so that a right-hand circular polarized wave is emitted from the slots. Consequently, the single antenna can concurrently transmit or receive the right-hand and left-hand circular polarized waves.

9 Claims, 3 Drawing Sheets

POLARIZATION-UNIVERSAL RADIAL LINE SLOT ANTENNA

FIELD OF TECHNOLOGY

The present invention relates to a radial line slot antenna utilizing a radial waveguide for use in SHF and EHF bands.

BACKGROUND FIELD

Conventionally, a parabolic antenna having a bowl shape is used in a satellite communication or else; however, recently a radial line slot antenna is developed instead of the parabolic antenna.

The radial line slot antenna is disclosed, for example, in Japanese Patent Publication No. 1-13241. Namely, a pair of metal disks are opposed to each other through a spacing, one of which is formed with slots for power emission. A peripheral metal wall is fitted along edges of these metal disks to form an inner waveguide spacing enclosed by these metal disks and the peripheral wall. A feeding means is provided to feed a power to the waveguide spacing such that the fed power is converged to a central portion of the waveguide spacing from the peripheral wall. The feeding means is comprised of a feeding source connected to the waveguide spacing, and an intermediate metal plate disposed in parallel to the pair of the metal disks such as to leave a gap relative to the peripheral wall within the waveguide spacing to provide a return pass of the fed power.

Generally, with regard to a circular polarized electromagnetic radiation having a certain frequency, there exist a right-hand circular polarization which rotates rightward in a traveling direction, and a left-hand circular polarization which rotates leftward in a traveling direction. However, the conventional radial line slot antenna cannot be used commonly to both of the right-hand and left-hand circular polarizations. Therefore, there is a drawback that a separate pair of antenna must be installed for the right-hand and left-hand circular polarization waves, though these waves have the same frequency.

In view of the above noted drawback, an object of the present invention is to provide a polarization-universal radial line slot antenna which can be commonly used for either of the right-hand and left-hand circular polarizations.

DISCLOSURE OF THE INVENTION

According to the invention, the radial line slot antenna comprises a slot plate having numerous slots, a frame opposed to the slot plate, a partition plate interposed between the slot plate and the frame to form an upper layer waveguide and a lower layer waveguide, and feeding means for feeding these waveguides. Characterizingly, the feeding means comprises first feeding means composed of a coaxial line having a tip end portion which protrudes through the partition wall into the upper layer waveguide to feed the same, and second feeding means composed of a dielectric member and a conductor member, which are formed coaxially around the coaxial line to feed the lower layer waveguide.

Further, according to the present invention, the polarization-universal radial line slot antenna comprises a slot plate having numerous slots, a frame opposed to the slot plate, a partition plate interposed between the slot plate and the frame to form an upper layer waveguide and a lower layer waveguide, and feeding means for feeding these waveguides. Characterizingly, the feeding means comprises a coaxial line disposed movably through an opening formed in a central portion of the partition plate, and a conductor piece attached to a tip end portion of the coaxial line and having a diameter greater than that of the opening.

In the inventive polarization-universal radial line slot antenna, a radio wave is fed to the upper layer waveguide by means of the first feeding means, and the same radio wave is also fed to the lower layer waveguide by means of the second feeding means. In such a construction, the slots are aligned along a spiral pattern which, for example, expands clockwise from the center, hence the slots are excited sequentially from the central ones to the peripheral ones when the upper layer waveguide is fed by the first feeding means, so that a left-hand circular polarized wave is emitted from the antenna. Further, when the lower layer waveguide is fed by the second feeding means, consequently the slots are sequentially excited from peripheral ones to the central ones so that a right-hand circular polarized wave is emitted, which rotates reversely to the aforementioned left-hand circular polarized wave, thereby achieving the object of the polarization-universal antenna. Further, the first and second feeding means are operated independently from each other so that both of the right-hand and left-hand circular polarized waves can be emitted concurrently with each other.

Further, in the other polarization-universal radial line slot antenna of the invention, the coaxial line is displaced integrally with absorption members such that the absorption members pass through respective holes formed in the central portions of the slot plate and the frame, while the coaxial line passes through the opening formed in the central portion of the partition plate, thereby selectively feeding either of the upper layer waveguide and the lower lager waveguide. In case that the slots are arranged along a spiral pattern which expands clockwise from the center to the periphery, when the upper layer waveguide is fed with a power, the slots are successively excited from central ones to the peripheral ones to thereby emit a radio wave of the left-hand circular polarization. On the other hand, when the lower layer waveguide is fed with a power, consequently the slots are excited successively from the peripheral ones to the central ones to thereby radiate a radio wave of the right-hand circular polarization which rotates reversely to the aforementioned case. Therefore, the antenna can be selectively and commonly used for either of the left-hand and right-hand circular polarizations to thereby achieve the object of the polarization-universal antenna construction.

BEST MODE FOR PRACTICING THE INVENTION

Figure 1:
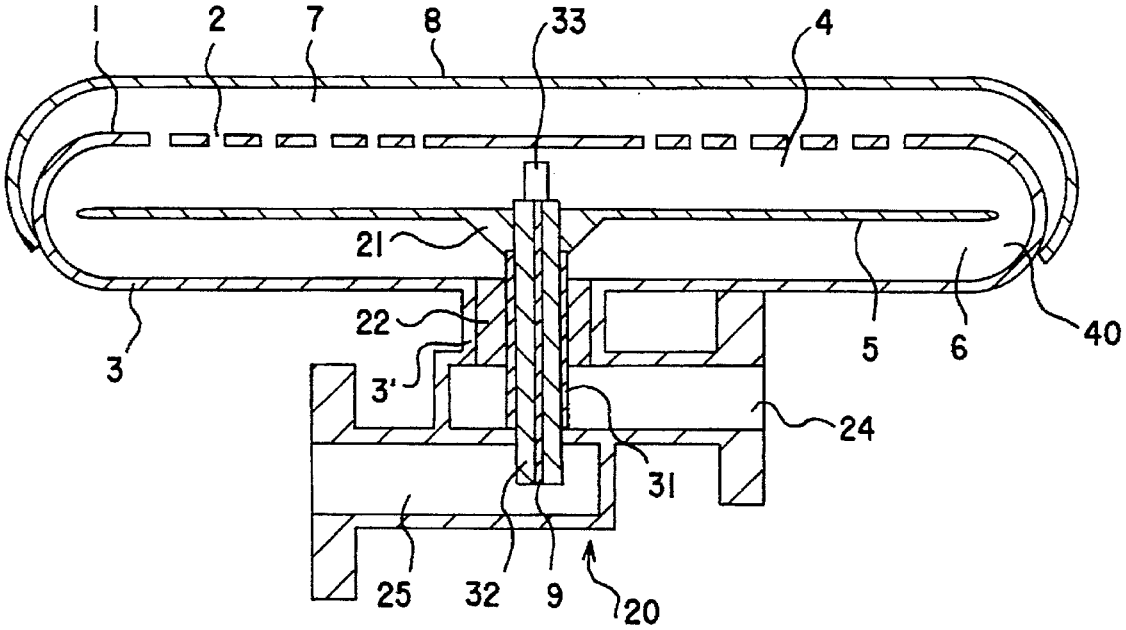
FIG. 1 is an axially sectional diagram showing an overall construction of one embodiment according to the invention.
Figure 2:
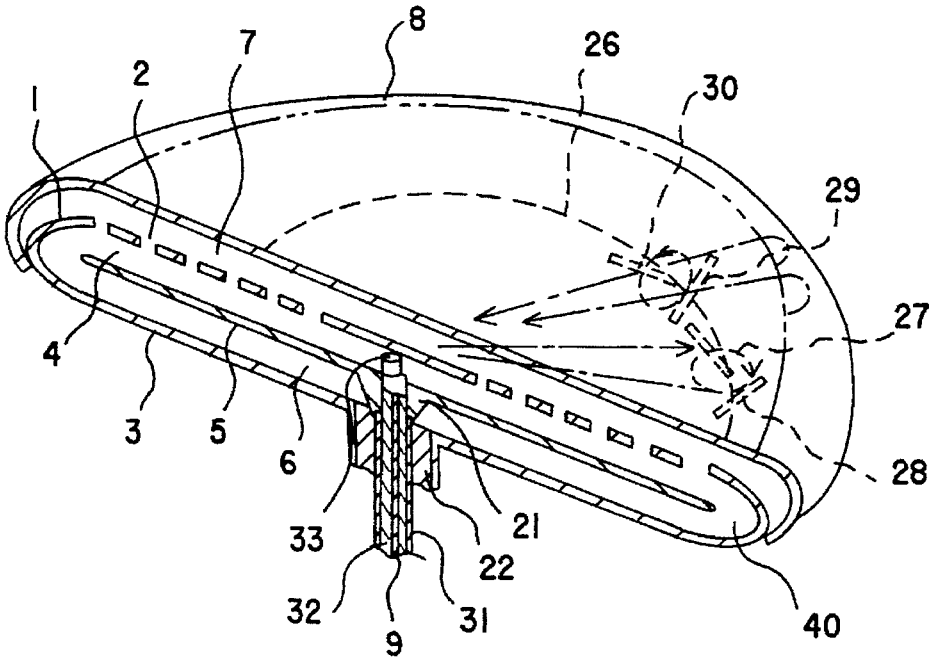
FIG. 2 is a partial perspective view thereof, FIG. 3 perspective diagram illustrative of feeding of an upper layer waveguide in another embodiment of the invention.
Figure 5:
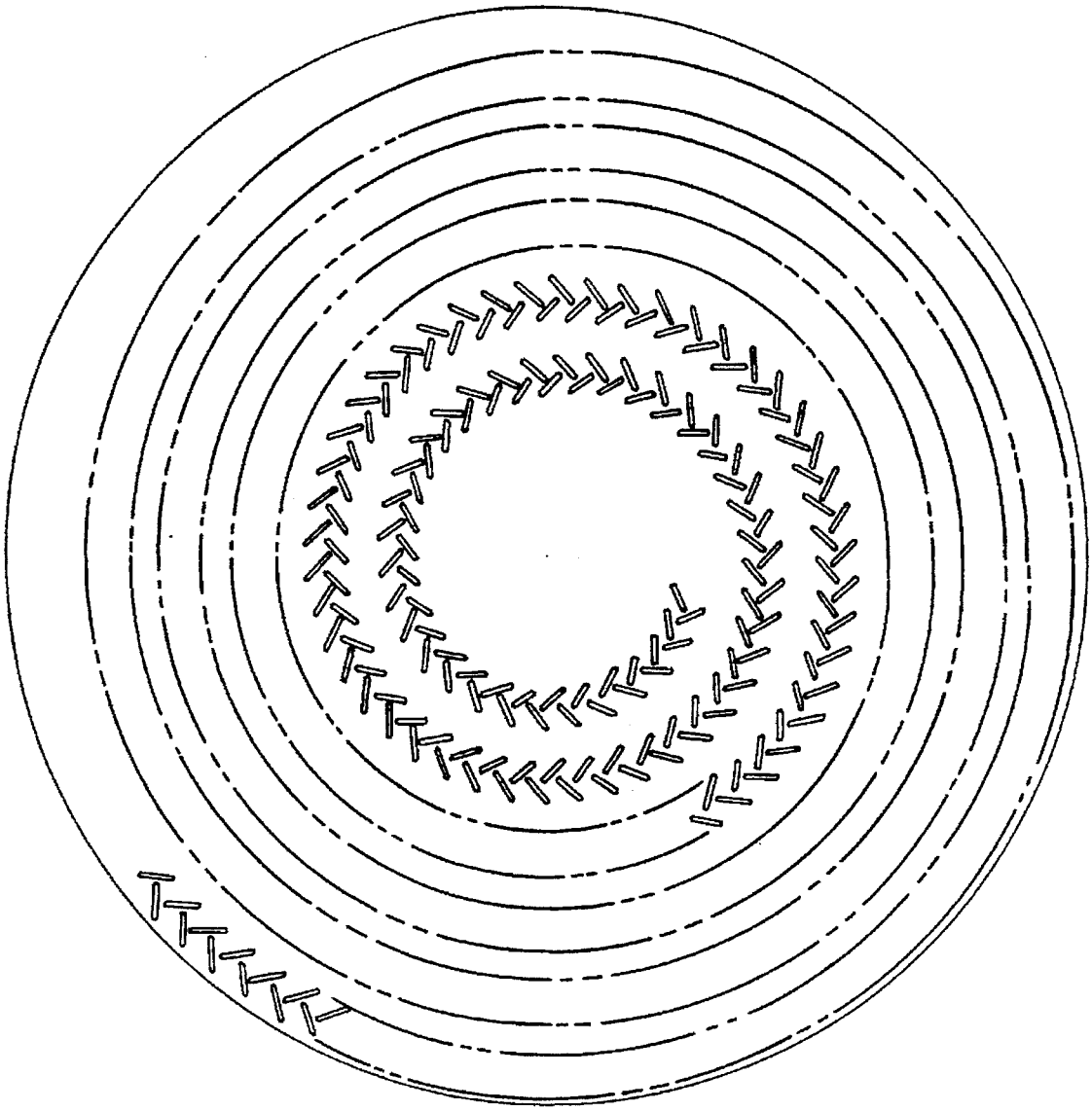
FIG. 5 is a plan view of a slot arrangement.

Referring to FIGS. 1 and 2, the antenna is provided with a slot plate 1 composed of a metal disk having numerous slots 2 formed by etching process or else. The slots 2 are arranged along a clockwise or counterclockwise spiral pattern which expands outward at a pitch of a waveguide wavelength $\lambda g$ when rotated. For example, as shown in FIG. 5, numerous slots having a T-shape are aligned along a clockwise spiral pattern.

A frame 3 is formed by drawing a peripheral portion of a metal disk material. This peripheral portion is coupled to the slot plate 2, and is sealed by an epoxy resin or else. Further, a partition plate 5 is interposed between the slot plate 1 and the frame 3 to internally form an upper layer radial waveguide 4, a lower layer radial waveguide 6, and a folded return pass 40 at a periphery.

A redome 8 is fitted on the slot plate 1 to prevent penetration of rain water or else. The radome 8 is molded by Teflon material or other smooth materials effective to avoid snow cover or else, and a periphery thereof is engaged with the frame 3 by sealing. If necessary, a spacer (not shown) composed of styrene foam or else may be inserted into a spacing 7 between the radome 8 and the slot plate 1. Further, a high foaming dielectric member may be filled into the lower layer radial waveguide 6.

First feeding means is provided in a central portion of the partition plate 5, and is composed of a coaxial line comprised of a core conductor member 9, a first dielectric member 32 and a first outer conductor member 31. Further, second feeding means is composed of a second dielectric member 22 disposed around the first outer conductor member 31, and a second outer conductor member 3' integrated with the frame and disposed coaxially with the first outer conductor member 31.

A transducer 20 is provided under the first and second feeding means, and has a waveguide tube 24 for feeding the lower layer radial waveguide 6 and another waveguide tube 25 for feeding the upper layer radial waveguide 4.

A second matching member 21 is provided around the first outer conductor member 31 within the lower layer radial waveguide 6.

Tip end portions of the core conductor member 9 and the first dielectric member 32 protrude upward through the partition plate 5. A first matching member 33 is disposed on top of the core conductor member 9. A bottom end of the core conductor member 9 protrudes together with the first dielectric member 32 into the waveguide tube 25 which is disposed under the other waveguide tube 24. On the other hand, the second dielectric member 22 has an axial length extending between the bottom of the lower layer radial waveguide 6 and the top of the waveguide tube 24. The second outer conductor member 3' is formed integrally with the frame 3 and the transducer 20.

Next, description is given to the feeding operation of the radial line slot antenna having the above disclosed construction. In the radial line slot antenna of the present embodiment, the waveguide tube 25 of the transducer 20 feeds an electromagnetic wave, which passes through the first feeding means, i.e., the coaxial line composed of the core conductor member 9, the first dielectric member 32 and the first outer conductor member 31, and which is then introduced into the upper layer radial waveguide 4 through the first matching member 33. Consequently, an axially symmetric radio wave of a most basic mode diverging from the center to the periphery is emitted from slots 27, 28 as a left-hand circular polarized wave, in case that the slots are arranged along a spiral pattern 26 which expands clockwise from the center as shown in FIG. 2.

Further, the first outer conductor member 31 functions as a core conductor member of the second feeding means. Namely, the waveguide tube 24 feeds an electromagnetic wave, which passes through another coaxial line composed of the first outer conductor member 31, the second dielectric member 22 and the second outer conductor member 3', and which is then introduced into the lower layer radial waveguide tube 6 by means of the second matching member 21. Consequently, an axially symmetric wave diverges from the center to the periphery within the lower layer radial waveguide 6, and is then folded into the upper layer radial waveguide 4 through the peripheral return pass 40 to thereby form a radio wave which converges to the center from the periphery, and which is finally emitted from slots 29, 30 as a right-hand circular polarized wave as shown in FIG. 2.

By such a construction, both of the right-hand and left-hand polarizations can be concurrently treated by the pair of the first and second feeding means. This is due to a two-wave coexistence performance which is basic in the radial waveguide. In the present embodiment, a low foaming dielectric material may be filled in the upper layer radial waveguide 4 for wave delay, and a high foaming dielectric material may be filled in the lower layer radial waveguide 6.

Next, another embodiment of the present invention will be described in conjunction with FIGS. 3 and 4. In these figures, the antenna is provided with a slot plate 1 composed of a metal disk having numerous slots formed by etching process. The slots 2 is arranged along a rightward or leftward spiral pattern which expands outward at a pitch of a waveguide wavelength $\lambda g$ when the slot plate is rotated. For example, as shown in FIG. 5, numerous slots of T-shape are aligned along a clockwise spiral pattern.

A frame 3 is formed by drawing a periphery of a metal disk material. The slot plate 1 is coupled to this periphery and is sealed by an epoxy resin or else along the periphery. Further, a partition plate 5 having a central opening 18 is interposed between the slot plate 1 and the frame 3 to form internally an upper layer radial waveguide 4, a lower layer radial waveguide 6, and a peripheral folded return pass 41. Further, an absorption member 10, a core conductor member 9 and a dielectric member 11 are fitted into a central portion of the slot plate 1. Moreover, an outer conductor member 19 and another absorption member 12 are disposed coaxially around the dielectric member 11.

These core conductor member 9, the dielectric member 11 and the outer conductor member 19 constitute a coaxial line, a lower end portion of which is connected to a transducer 20 of a two-layer structure. This transducer 20 has an internal separating wall 15 to divisionally form a top layer waveguide tube 14 for feeding the upper layer radial waveguide 4 and a bottom layer waveguide tube 16 for feeding the lower layer radial waveguide 6.

A redome 8 is fitted over the slot plate 1 to prevent penetration of rain water or else. This redome 8 is molded with a Teflon or other smooth materials effective to avoid snow deposit or else. A periphery thereof is engaged with the frame 3 and is sealed thereto. If necessary, a spacer (not shown) such as a styrene foam may be filled in a spacing 7 between the radome 8 and the slot plate 1. In manner similar to the previous embodiment, a high foaming dielectric member may be filled within the lower layer radial waveguide 6.

Next, specific description is given to those of the core conductor member 9, dielectric member 11, and pair of absorption members 10, 12. The absorption member 10 is smaller than a hole 17 formed in a central portion of the slot plate 1 so that the absorption member 10 can displace up and down through the hole 17 relative to the slot plate 1.

The core conductor member 9 has a T-shape section such that a top piece **9*a* thereof has a size greater than the opening 18 of the partition plate 5 so as to close the opening 18. The absorption member 10 is disposed on the top piece 9*a* of the core conductor member 9**.

The coaxial line composed of the core conductor member 9 covered coaxially by the dielectric member 11 and the outer conductor 19 extends downward from the center of the partition plate 5 through another hole 3*a* formed in a central bottom portion of the frame 3. The outer conductor member 19 of the coaxial line has a flange at the top end portion thereof so as to close the hole 3*a*. The flange is positioned in spaced relation from the top piece 9*a* of the core conductor member 9 to provide an upper exposed portion 11*a* along the dielectric member 11 between the top piece 9*a* and the flange. Further, the outer conductor member 19 is shaped to provide a lower exposed portion 11*b* along the dielectric member 11.

The other absorption member 12 is disposed around the outer conductor member 19 to pass through the hole 3*a*. The absorption member 10, core conductor member 9, dielectric member 11, outer conductor member 19 and absorption member 12 constitute altogether the feeding means which can displace up and down.

The description is given to switching operation of the feeding means. The feeding means is displaced upward in order to feed the upper layer radial waveguide 4. Namely, as shown in FIG. 3, the absorption member 10 is positioned between the slot plate 1 and the radome 8, while the top piece 9*a* of the core conductor member 9 closes the hole 17 of the slot plate 1. Further, the upper exposed portion 11*a* of the dielectric member 11 is placed in the upper layer radial waveguide 4, the flange of the outer conductor member 19 contacts the partition plate 5, the absorption member 12 is placed in the lower layer radial waveguide 6, and the lower exposed portion 11*b* of the dielectric member 11 is positioned in the upper waveguide tube 14 of the transducer 20.

Figure 3:
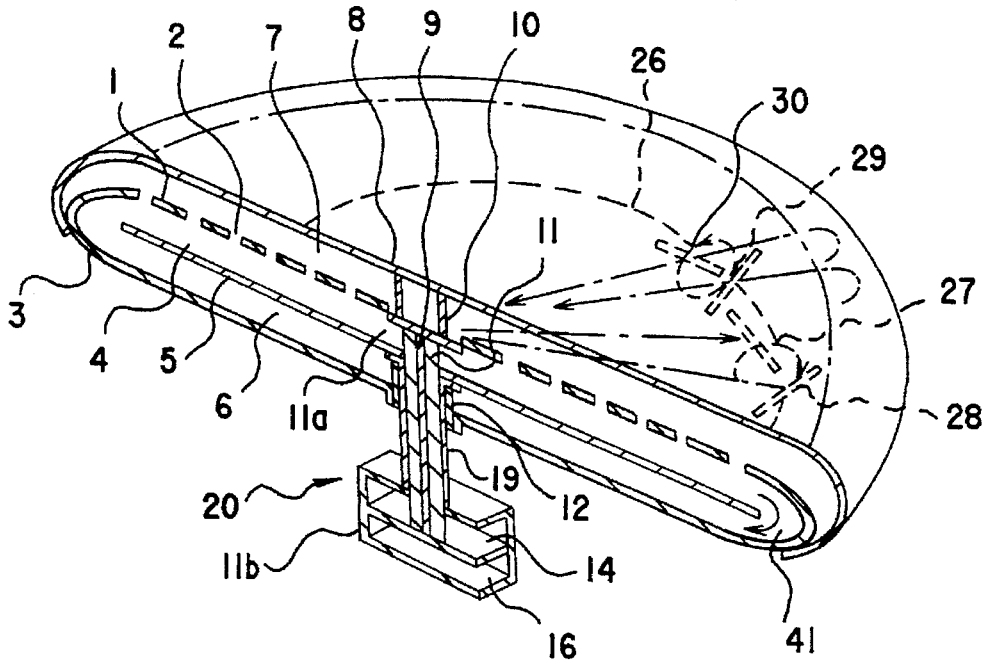

Accordingly, in case that the feeding means is set in the position of FIG. 3, the upper waveguide tube 14 feeds an electromagnetic wave to the dielectric member 11 through the lower exposed portion 11*b*. The electromagnetic wave is then fed to the upper layer radial waveguide 4 from the upper exposed portion 11*a*. Consequently, a most basic radio wave of an axially symmetric mode diverging from the center to the periphery is emitted from slots 27, 28 in the form of a left-hand circular polarized wave, in case that the slots are arranged along the spiral pattern 26 which expands rightward from the center. Further, the remaining radio wave which has not been emitted is absorbed by the absorption member 12 in the lower layer radial waveguide 6.

Next, the feeding means is displaced downward in order to feed the lower layer radial waveguide 6. As shown in FIG. 4, the absorption member 10 is positioned between the slot plate 1 and the partition plate 5, and the top piece 9*a* of the core conductor member 9 closes the opening 18 of the partition plate 5. Further, the upper exposed portion 11*a* of the dielectric member 11 is positioned in the lower layer radial waveguide 6, the flange of the outer conductor member 19 comes into contact with a periphery of the hole 3*a* in the bottom central portion of the frame, the other absorption member 12 is positioned outside the frame, and the lower exposed portion 11*b* of the dielectric member 11 is placed in the lower waveguide tube 16 of the transducer 20.

Figure 4:
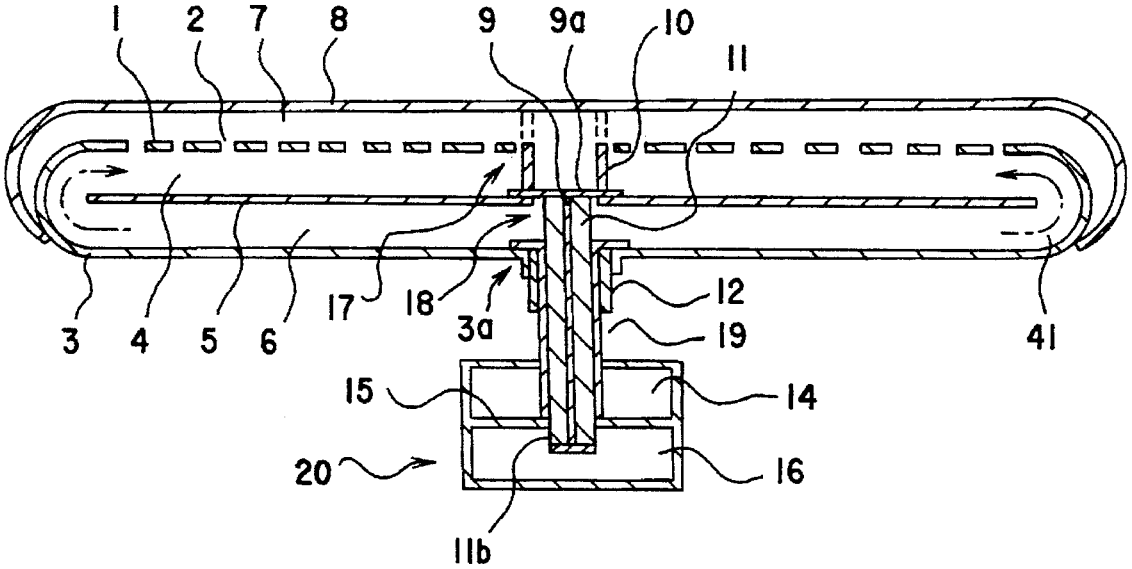
FIG. 4 is an axially sectional diagram illustrating feeding of a lower layer waveguide in said another embodiment.

Accordingly, when the feeding means is set in the position of FIG. 4, the lower waveguide tube 16 feeds a radio wave to the dielectric member 11 through the lower exposed portion 11*b*. The radio wave is then fed to the lower layer radial waveguide 6 from the upper exposed portion 11*a* of the dielectric member 11. Consequently, an internal radio wave diverges radially from the center to the periphery in the lower layer radial waveguide 6, and is then folded by the peripheral return pass 41 to thereby travel into the upper layer radial waveguide 4 to converge from the periphery to the center. Consequently, a right-hand circular polarization wave is emitted from slots 29, 30.

In the radial line slot antenna of this embodiment, the feeding means is switched as described above to select either of the right-hand and left-hand circular polarized waves.

Industrial Applicability

As described above, the inventive radial line slot antenna can commonly deal with either of the right-hand and left-hand circular polarizations. Thus, a single antenna can be used to transmit and receive an electromagnetic wave of a satellite broadcast or else.

We claim:

1. A polarization-universal radial line slot antenna comprising: a slot plate having numerous slots; a frame opposed to the slot plate; a partition plate interposed between the slot plate and the frame to form an upper layer waveguide and a lower layer waveguide; and feeding means for feeding these waveguides, wherein the feeding means comprises first feeding means composed of a coaxial line having a tip end portion which protrudes through the partition plate into the upper layer waveguide so as to feed the same, and second feeding means composed of a dielectric member and a conductor member which are coaxially disposed around the coaxial line so as to feed the lower layer waveguide.

2. An antenna apparatus comprising an upper slot plate having numerous slots; a lower frame opposed to the upper slot plate; an intermediate partition plate interposed between the upper slot plate and the lower frame so as to form an upper radial waveguide between the upper slot plate and the intermediate partition plate, a lower radial waveguide between the intermediate partition plate and the lower frame, and a peripheral pass connecting between the upper radial waveguide and the lower radial waveguide; and feeding means provided axially through a central portion of the partition plate for feeding a radio wave to the upper radio waveguide so that the radio wave radially diverges through the upper radio waveguide to successively excite the slots in a radially outward direction, and for feeding another radio wave to the lower radial waveguide so that the radio wave diverges through the lower radial waveguide in a radially outward direction and then enters into the upper radial waveguide through the peripheral pass to converge through the upper radial waveguide to thereby successively excite the slots in a radially inward direction.

3. An antenna apparatus according to claim 2; wherein the feeding means comprises first feeding means fixedly disposed in the upper radial waveguide for feeding thereto a radio wave, and second feeding means fixedly disposed in the lower radial waveguide for feeding thereto another radio wave.

4. An antenna apparatus according to claim 3; wherein the first feeding means comprises a coaxial line having a tip end portion protruding through the central portion of the partition plate into the upper radial waveguide, and the second feeding means comprises a dielectric member and an outer conductor member, which are disposed coaxially around the coaxial line.

5. An antenna apparatus according to claim 4; wherein the first feeding means has a first matching member disposed on the tip end portion of the coaxial line, and the second feeding means has a second matching member formed around the central portion of the partition plate.

6. An antenna apparatus according to claim 2; wherein the feeding means comprises movable feeding means displacable axially in the central portion of the partition plate, and being switchable between an upper position for selectively feeding a radio wave to the upper radial waveguide and a lower position for selectively feeding another radio wave to the lower radial waveguide.

7. An antenna apparatus according to claim 6; wherein the movable feeding means comprises a coaxial line having a tip and portion which is placed in the upper radial waveguide when the movable feeding means is switched to the upper position, and which is placed in the lower radial waveguide when the movable feeding means is switched to the lower position.

8. An antenna apparatus according to claim 7; wherein the movable feeding means has an upper absorption member disposed on the tip end portion of the coaxial line for absorbing a remaining radio wave and being placed in the upper radial waveguide when the movable feeding means is switched to the lower position, and a lower absorption member fitted around the coaxial line for absorbing a remaining radio wave and being placed in the lower radial waveguide when the movable feeding means is switched to the upper position.

9. An antenna apparatus according to claim 2; wherein the slot plate has numerous slots arranged along a spiral pattern such that the slots can emit one of right-hand and left-hand circular polarized waves when the radio wave diverges through the upper radial waveguide, and can emit the other of right-hand and left-hand circular polarized waves when the radio wave converges through the upper radial waveguide.

* * * * *